United States Patent [19]

Gelinas et al.

[11] Patent Number: 4,936,060

[45] Date of Patent: Jun. 26, 1990

[54] FLEXIBLE ROOF CONTROL SYSTEM

[75] Inventors: Richard Gelinas, Indianapolis; Richard Meyer, West Point; Gerald Hauersperger; Steve Osswald, both of Indianapolis; Michael Hall, Pittsboro; Michael Wetzel, Indianapolis, all of Ind.

[73] Assignees: J. W. Welsh & Associates, Inc., Marion County; The Capital Improvement Board of Managers, Indianapolis, both of Ind. ; a part interest

[21] Appl. No.: 258,195

[22] Filed: Oct. 14, 1988

[51] Int. Cl.[5] ..... E04H 9/00

[52] U.S. Cl. ..... 52/1; 52/2 H; 52/2 G; 52/2 R

[58] Field of Search ..... 135/1; 52/2, 83, 169.7, 52/1, 2 D, 2 H

[56] References Cited

U.S. PATENT DOCUMENTS

| | | | |
|---|---|---|---|
| 2,910,994 | 11/1959 | Joy | 52/2 |
| 2,948,286 | 8/1960 | Turner | 52/2 X |
| 3,024,796 | 3/1962 | Bird | 52/2 |
| 3,159,165 | 12/1964 | Cohen et al. | 52/2 X |
| 4,479,053 | 10/1984 | Johnston . | |

OTHER PUBLICATIONS

CannonBear, Product Specifications: Fathom 1001 Level Transmitter.

Omron, Type E3S-LS20X, Photoelectric Switch Instruction Manual.

Johnson Controls, DSC-8500 Digital System Controller, 1987.

Berdahl, Short-Range Self-Pulsed Optical Radar, NASA Tech Briefs, Winter 1980.

Johnson, a Refresher in Position Sensing, Sensors, Sep. 1987.

Johnson Controls, DSC-Network Configurations.

NASA, Measuring Water-Layer Thickness, Technical Support Package for Tech Brief LAR-13347, Sep. 1986.

Everett, Noncontact Ranging Systems for Mobile Robots, Sensors, Apr. 1987.

Judd, Interfacing Sensors to Measurement Equipment, Sensors, Sep. 1986.

Vig, Light Sensing Using Optical Integrated Circuits, Sensors, Aug. 1986.

Perry, Ultrasonic Instrumentation in Principle and Practice, Sensors, Oct. 1987.

Johnston and Shimada, Optical Traffic-Sensing Concept, NASA Tech Briefs, Spring 1978.

*Primary Examiner*—David A. Scherbel

*Assistant Examiner*—Linda J. Hoffert

*Attorney, Agent, or Firm*—Barnes & Thornburg

[57] ABSTRACT

A system for controlling a flexible roof assembly of the type used to cover large structures determines the actual variable height of one or more sections of the roof assembly with respect to a fixed reference point and regulates the apparatus for elevating the roof assembly to accurately control the position of the roof assembly. The system includes a signal generator for generating a signal corresponding to the actual height to indicate a change in height of the roof assembly. The system may also include an apparatus for detecting the presence of either ice or snow in an area of an outer surface of the roof assembly. The detecting apparatus includes a collecting device that is oriented to collect snow and ice that is accumulating and a sensor unit directed toward the collecting device to detect an accumulation of ice or snow that reaches a specified depth.

30 Claims, 3 Drawing Sheets

FLEXIBLE ROOF CONTROL SYSTEM

BACKGROUND AND SUMMARY

The present invention relates to a system for monitoring and controlling a flexible roof assembly. More particularly, the present invention relates to a system for monitoring and controlling the height of a flexible roof system of the type normally used on covered sports stadiums, etc. Additionally, the present system includes a device for detecting any accumulation of ice or snow on the outer surface of the roof so that the ice or snow can be quickly eliminated.

Flexible roof assemblies have become somewhat common for sports stadiums in very recent years. Flexible roof assemblies for such stadiums are advantageous because of their lower installation costs, and because of the ability to cover larger areas than may be practically possible with rigid or structural type roofs. The principal advantage of a flexible roof system is that it does not require an elaborate rigid support system for supporting the roof. It will be understood that, in covered sports stadiums, the presence of any supporting structures for supporting the roof which extend into the interior of the stadium are undesirable. Therefore, the only practical alternatives for constructing a roof assembly for a large covered stadium which will have an unobstructed view for all attendees is to either provide a rigid roof assembly which is supported at its edges, or to provide a flexible roof system which is supported by air pressure within the stadium.

It will be understood that a rigid roof structure which spans the type of distances normally associated with large sports stadiums can be extremely complicated and extremely expensive. Because a flexible roof system is supported principally by a slight positive pressure within the stadium, the flexible roof need not be structurally rigid itself. In contrast, the typical flexible roof assembly cannot support itself in the absence of a required positive pressure within the stadium. This lack of structural rigidity eliminates the problems normally associated with constructing a rigid type of roof and greatly decreases the cost of such a roof.

A conventional flexible roof is maintained in position by constantly maintaining a positive pressure within the stadium with respect to the atmospheric pressure outside of the stadium Typically, one inch of positive pressure is normally maintained within the stadium with respect to the atmospheric pressure outside of the stadium to maintain such a flexible roof assembly in its proper orientation. It will be understood that the actual pressure within the stadium and the actual pressure exterior to the stadium are not critical, so long as the pressure differential between the inside and the atmosphere is maintained at the required difference such that a positive pressure is always maintained within the stadium.

Because of the necessity of maintaining the flexible roof at its proper height, it will be understood that monitoring systems are necessary to constantly monitor the pressure differential between the interior and atmospheric pressure. These monitoring systems are normally coupled to a system of fans or air handling units which are designed to introduce air into the structure to maintain the pressure differential, thereby maintaining the roof in the proper position. Normally, the system of fans includes a plurality of individually operating fans, which are sequentially placed into operation depending upon the signals received from the monitoring system. When the monitoring system detects a lower than required pressure differential, individual fans or pairs of fans are sequentially activated to increase the pressure within the structure. It will be understood that there are many variables which affect the pressure within the structure. Doors may be opened which can release a great amount of the pressure within the structure within a short period of time, creating a decrease in the required pressure differential. Additionally, temperature changes can result in pressure fluctuations which must be compensated for by the fan system.

Although the conventional monitoring systems are generally capable of controlling the fan system such that a desired pressure differential is maintained to keep the roof assembly in the proper position, it will be understood that by simply monitoring pressure differential, the actual height of the roof is not taken into consideration. Monitoring the pressure differential between the interior of the structure and the atmosphere is simply an indication of the position of the roof structure when all other conditions are normal. Under certain circumstances, the actual position of the roof could be considerably different than the indicated position of the roof relying solely upon the pressure differential. For example, if the roof structure accumulates a build-up of ice or snow, the weight of roof assembly will increase. This increased weight may cause the roof assembly to decrease in height. Using this example, by merely monitoring the pressure differential between the interior of the structure and the atmosphere, such a lowering in height of the roof would probably go undetected, at least for a period of time. Thus, with such conventional systems, the height of the roof can change somewhat without such a change being indicated by conventional pressure monitoring systems. Thus, it would be advantageous to provide a system for monitoring and controlling a flexible roof assembly which could determine and monitor the actual height of the roof assembly and utilize such actual height measurements to accurately control the roof.

It is therefore one object of the present invention to provide a flexible roof control system in which the actual height of the roof is used to control the input of air into the structure.

Another object of the present invention is to provide a flexible roof control system in which radar units are utilized to measure accurately the actual height of the roof.

Yet another object of the present invention is to provide a flexible roof control system in which an average actual height measurement is provided so that fluctuations in height of one section of the roof which are compensated for by opposite direction fluctuations of another section of the roof are averaged out.

Yet another object of the present invention is to provide a flexible roof control system which is capable of detecting accumulation of ice or snow on the outer surface of the roof before the accumulation becomes significant, with the system capable of distinguishing between ice and snow accumulation and simply water present on the roof.

According to the present invention, a system for monitoring and controlling the position of a flexible roof assembly of a building structure is provided. The system includes means for forcing air into the building structure to elevate the roof assembly and at least one echo ranging device for determining the actual height of at least one section of an inter portion of the roof assembly to produce an actual height measurement. The system also includes means for controlling the air forcing means in response to the actual height measurement of the at least one section of the roof assembly such that the position of the roof assembly is accurately controlled.

One feature of the foregoing structure is that the actual height of at least one section of the roof assembly is determined to produce an actual height measurement. One advantage of this feature is that, by monitoring the actual height of the roof, changes in the position of the roof are immediately detected and can be quickly controlled.

Another feature of the foregoing structure is that means for controlling the air forcing means are provided, with the controlling means being responsive to the actual height measurement of the roof assembly. One advantage of this feature is that the forcing means are directly controlled by controlling means in response to the actual height measurement of the roof assembly.

In preferred embodiments of the present invention, the system further includes means for detecting ice and snow accumulation on an outer surface of the roof assembly. One feature of the foregoing structure is that means are provided for specifically detecting ice and snow accumulation, with the means being able to distinguish between ice and snow accumulation and merely rain water accumulation. One advantage of the foregoing structure is that ice and snow accumulation on the roof assembly can be detected and controlled before such accumulation can build up to harmful levels.

Also in preferred embodiments of the present invention, there are a plurality of echo ranging devices, with each echo ranging device measuring the height of a designated section of the roof assembly, with calculating means being provided to calculate an average height of all of the designated sections of the roof assembly. The average height is then utilized to generate an average height signal. One feature of the foregoing structure is that multiple echo ranging devices are provided to measure the actual height of several designated, separate portions of the roof assembly, with an average height then calculated to produce an average height signal. One advantage of the foregoing structure is that, by producing an average height signal, normal fluctuations in the height of the roof which do not require an adjustment of the air input into the structure can be averaged out.

Also in preferred embodiments of the present invention, means for alternately activating each echo ranging device during separate distinct time periods such that only one echo ranging device is transmitting an echo signal during any one time period is provided. One advantage of the foregoing structure is that, by alternating the operation of the separate echo ranging devices, the potential for interference between the multiple echo ranging devices is eliminated.

Thus, the present invention provides a system for accurately monitoring and controlling the position of a flexible roof assembly by utilizing the actual height of the roof assembly as the controlling perimeter. By utilizing the actual height of the roof assembly, the position of the roof assembly can be maintained accurately, and small changes in the height of the roof assembly which can indicate a trend in movement of the roof assembly, can be detected immediately and compensated for. This system is a significant improvement over conventional systems which merely monitor the pressure differential between the interior of the structure relative to the atmosphere. Such conventional systems are incapable of detecting small changes in the position of the roof assembly which could indicate potentially dangerous trends in movement of the roof.

Additional objects, features, and advantages of the invention become apparent to those skilled in the art upon consideration of the following detailed description of a preferred embodiment exemplifying the best mode of carrying out the invention as presently perceived.

BRIEF DESCRIPTION OF THE DRAWINGS

FIG. 5 is a diagrammatic illustration of the components of the monitoring and control system.

DETAILED DESCRIPTION OF THE DRAWINGS

Figure 1:
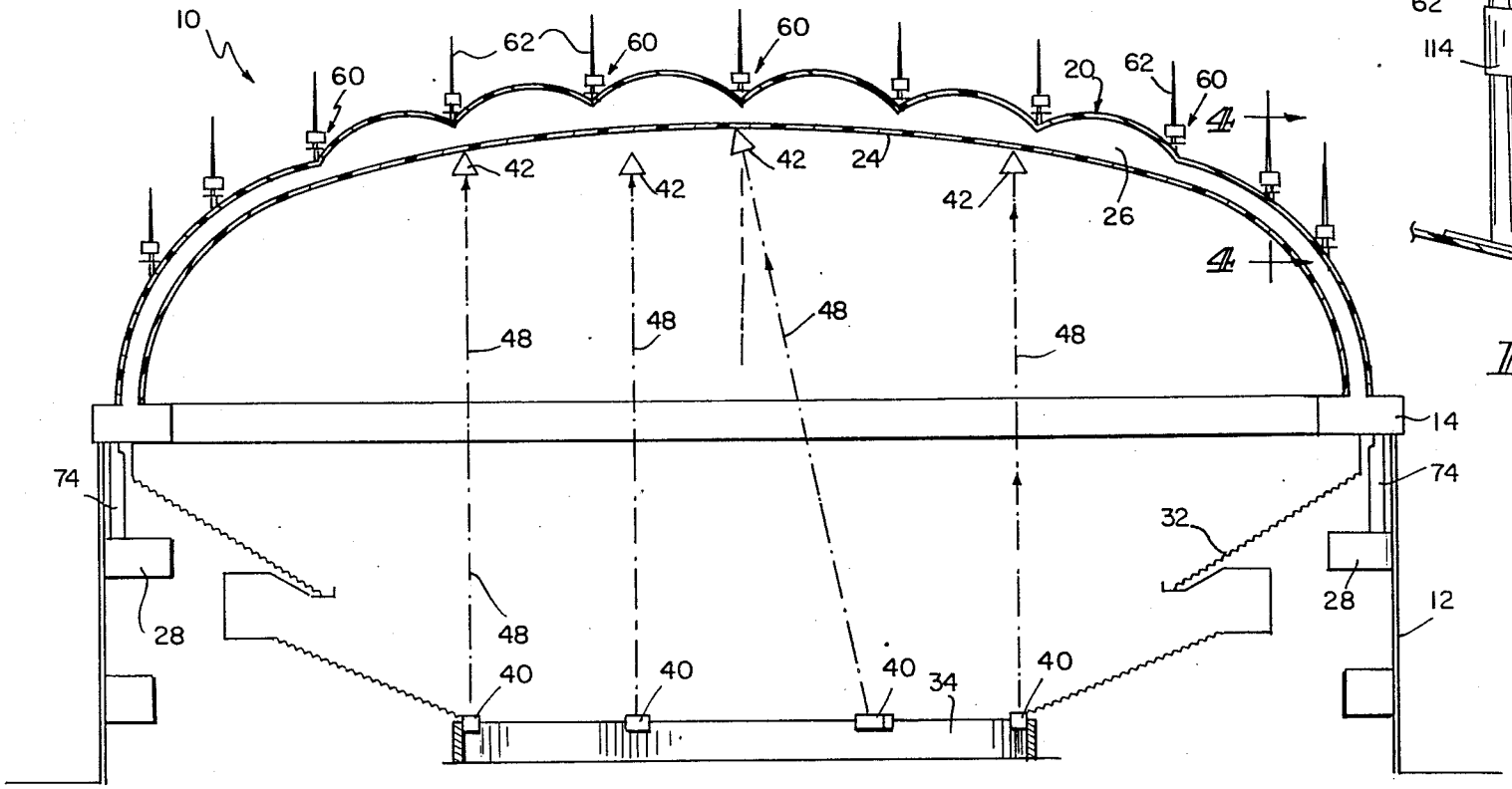
FIG. 1 is a diagrammatic illustration of the structure of a building having a flexible roof assembly that is supported by pneumatic pressure within the structure, with a monitoring system according to the present invention installed.

Referring now to the drawings, FIG. 1 shows a cross section of a typical dome structure 10 of the type commonly used as a domed sports arena for football and other sports where a large covered area is desirable. The dome structure 10 includes a rigid base structure 12 which normally extends upwardly approximately a distance equal to ½ of the total height of the structure 10. The structure 12 may be formed of concrete or other rigid material and terminates at its upper portion in a ring beam portion 14.

A flexible roof assembly 20 is shown which forms a complete dome-like cover for the dome structure 10. The flexible roof assembly 20 is attached to the dome structure 10 at the ring beam portion 14. The flexible roof assembly 20 is a two-layer structure which includes an outer roof layer 22 and a separate inner roof layer 24. The space between the outer roof layer 22 and the inner roof layer 24 creates a roof cavity 26, one purpose of which will be discussed below.

The flexible roof assembly 20 is supported entirely by maintaining a positive air pressure differential between the inside of the dome structure 10 relative to the atmosphere. Normally, one inch of positive pressure is maintained within the dome structure 10 relative to the atmosphere, with this positive pressure differential sufficient to keep the flexible roof assembly 20 elevated to its proper position as illustrated in FIG. 1. The positive pressure differential is created and maintained by a series of air handling units 28 (only two of which are shown in FIG. 1) which act to introduce air into the dome structure 10 on demand. Illustratively, in the preferred embodiment, there are a total of sixteen air handling units 28, with four of the units being variable air volume units each having a capacity of approximately 100,000 cubic feet per minute (cfm). The four variable volume air handling units 28 introduce outside air into the dome structure 10 upon demand. The remaining 12 air handling units 28 are normally operated in tandem upon demand, with the modulation of each pair of remaining air handling units 28 being controlled by adjusting the amount of outside air with the amount of return air which is forced through each of the units 28.

The air handling units 28 are controlled depending upon the actual height of the roof assembly 20 such that an appropriate amount of input air is forced into the dome structure 10 to keep the flexible roof assembly 20 in the fully elevated position. The system for determining and monitoring the actual height of the roof assembly 20 and for controlling the air handling units 28 will be discussed below.

The dome structure 10 includes a seating area 32 within the rigid base structure 12. A lower retaining wall 34 is shown which is permanently positioned to encircle the playing field (not shown) of the dome structure 10. It will be understood that the playing field (not shown) may be used for football or possibly for baseball, with the dome structure 10 providing a year-around climate controlled enclosure for the arena.

Previous dome structures prior to the present invention have maintained the flexible roof in its proper position by merely monitoring the pressure within the structure relative to the atmospheric pressure such that a fairly constant pressure differential is maintained. By maintaining a fairly constant pressure differential, it has been assumed that the roof will remain in its proper position. Prior to the present invention, the actual position of the roof was not monitored or utilized in maintaining the correct pressure differential within the structure. However, because there are several factors which can influence the actual position of the roof even when the proper pressure differential is being maintained, simply monitoring the pressure differential and assuming that the roof will remain in its proper position has proven to be unsatisfactory. Therefore, the present invention is directed to determining and utilizing the actual height of the roof at any period in time, with the actual height measurement utilized to control the air handling units 28 such that the actual height of the roof assembly 20 is maintained constantly in the proper position.

In order to determine the actual height of the roof assembly 20 on a continuous basis, a number of radar units 40 are provided. In the illustrative embodiment, five radar units 40 are provided that are mounted on the lower retaining wall 34. Each radar unit 40 is directed upwardly toward an associated reflector 42, with the five reflectors 42 attached to the inner roof layer 24 of the flexible roof assembly 20. It will be understood that the reflectors 42 are needed in order to properly reflect a radar signal transmitted by each of the radar units 40. Illustrating, in the preferred embodiment, the radar units 40 are FATHOM TM 1001 radar units which are available from CannonBear Inc., 771 South Oak, Iowa Falls, Iowa 5126. These radar units are capable of detecting a range of between one inch up to 200 feet on a continuous basis. The units operate at a frequency in excess of 10 billion Hertz which enables them to be unaffected by normal equipment utilized within a typical sports arena, including typical internal radio communication transmissions. It will be understood that, although not shown, the opposite configuration of the reflectors 42 and the radar units 40 could be used. That is, the radar units 40 could be mounted on the inner roof layer 24, with the associated reflectors 42 mounted on the lower retaining wall 34. Of course, other configurations are possible where some of the radar units 40 are mounted on the lower retaining wall 34 and some are mounted on the inner roof layer 24, so long as the associated reflectors 42 are mounted in the opposite location. Additionally, when one or more of the radar units 40 is located on the inner roof layer 24, the associated reflector 42 could be located at a position other than on the lower retaining wall 34. For example, the associate reflector 42 could be located below a finished floor surface (not shown) of the playing field (not shown), or on an upper retaining wall (not shown) which may be a part of the structure 10.

The reflectors 42 are ideally pyramid-shaped and are oriented and four of the five reflectors 42 are located to be directly above the corresponding radar units 40. The one exception to this location is the center reflector 42 which is located in the center of the flexible roof assembly 20. The orientation of the associated radar unit 40 for the center reflector 42 is angled somewhat due to the location of the associated radar unit 40 on the lower retaining wall 34. Thus, four of the radar units 40 are directed vertically toward the associated reflectors 42, with the fifth radar unit 40 directed at somewhat of an angle toward the center of the roof assembly 20. The four vertically oriented radar units 40 and associated reflectors 42 are located such that the actual height measurements when the flexible roof assembly 20 is in its proper location will all be equal. It will be understood that, because of the angled orientation of the fifth radar unit 40 and associated reflector 42, this measurement will be somewhat greater. However, this increased measurement due to the angled orientation of the fifth radar unit 40 and associated reflector 42 is compensated for in the control system which will be discussed later so that all radar measurements will be equal when the roof assembly 20 is in its proper position.

As shown in FIG. 1, each individual radar unit 40 generates a radar signal toward the associated reflector 42 as indicated by the dash lines 48. Each radar signal 48 is transmitted from each radar unit 40 toward the associated reflector 42, and then reflects off of the associated reflector 42 back toward the radar unit 40. Each radar unit 40 operates in a conventional manner to utilize the time delay between the transmission of the radar signal 48 and the reception of the reflected signal to determine the actual distance between the radar unit 40 and the associated reflector 42. In order to eliminate any possible interference problems between the five radar units 40, the radar units 40 are controlled such that only one radar unit 40 is operating during any specific period of time. Thus, each radar unit 40 is controlled so that each operates during a specified, separate period of time, with the radar units 40 operated sequentially. During each operating cycle, five separate height measurements are made. These five height measurements are then utilized as an input to the control system which will be discussed later in the discussion related to FIG. 5.

In addition to the radar height determining system, the present invention further includes an ice detecting system for detecting any buildup of ice or snow (not shown) on the outer surface of the outer roof layer 22. It will be understood that it is extremely important to be able to detect any accumulation of ice or snow on the outer roof layer 22 because of the significant amount of additional weight which even a small accumulation of ice or snow might add to the weight of the flexible roof assembly 20. Indeed, many problems which have occurred related to flexible roof assemblies on dome structures in general have resulted from an undetected accumulation of ice or snow on the roof. Thus, the present invention includes a system which is capable of detecting any accumulation of ice or snow on the outer roof layer 22 of the flexible roof assembly 20, and for eliminating this accumulation and preventing further accumulation.

The ice detecting system includes a plurality of ice detecting units 60 which are individually attached to separate lightning rods 62 which are permanently attached to the outer roof layer 22. It will be apparent from the following discussion that the use of the already-installed lightning rods 62 is not mandatory, and that their use is simply an efficient way to mount the individual ice detecting units 60.

Although the specific structure of the ice detecting unit 60 will be discussed later in the discussion related to FIG. 4, a brief discussion of the overall operation of the ice detecting system will be presented here. The ice detecting units 60 are small focusable infrared photoelectric switches which are capable of detecting any object within a certain range. The photoelectric switches are arranged such that they are capable of detecting a predetermined accumulation of either ice or snow in the vicinity of the outer roof layer 22. Whenever a sufficient number of the ice detecting units 60 measure a predetermined accumulation of ice or snow, hot air is directed into the roof cavity 26 which acts to melt the existing accumulation of ice or snow, and to prevent further additional accumulation. The hot air is forced into the roof cavity 26 from the appropriate air handling unit 28 through duct work 74. The specific structure provided for directing and controlling this hot air upon a detected accumulation of ice or snow will be discussed later in the discussion related to FIG. 3.

Figure 2:
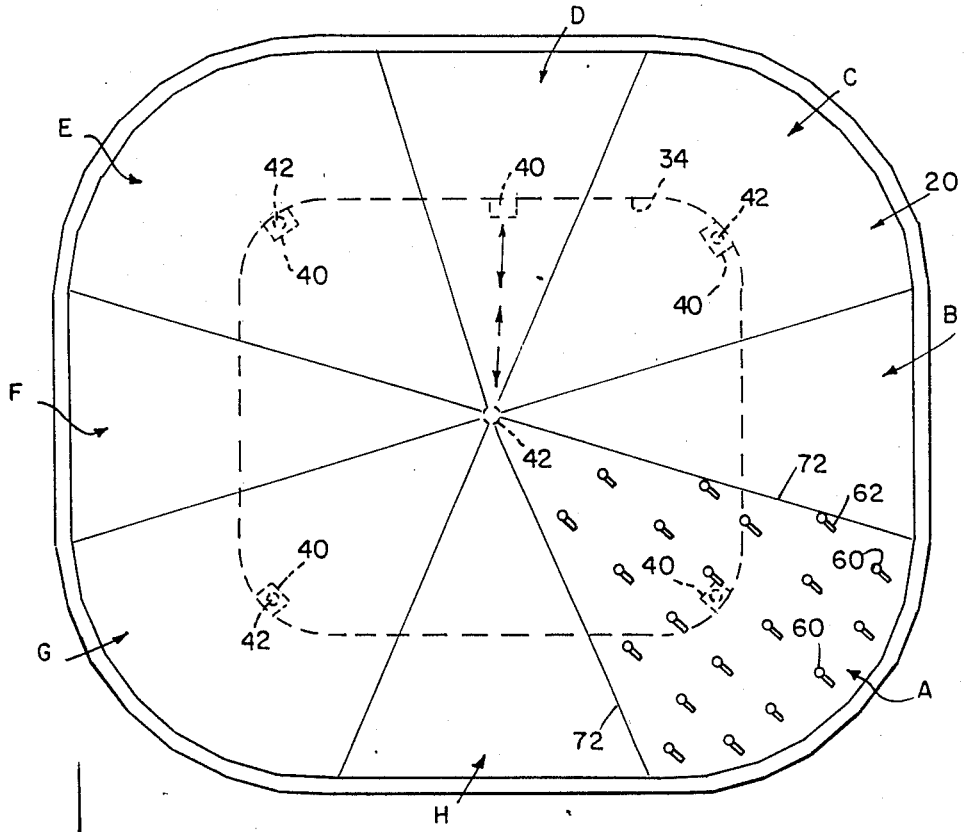
FIG. 2 is a diagrammatic plan view of the structure illustrated in FIG. 1 showing the separate designated zones of the roof assembly and showing the ice and snow detecting devices mounted in one zone.

FIG. 2 shows a somewhat diagrammatic plan view of the flexible roof assembly 20, and illustrates that the roof assembly 20 has been divided into eight somewhat pie-shaped zones A–H by arbitrary lines 72. Each zone A–H includes approximately 20 lightning rods 62, with a separate ice detecting unit 60 attached to each of the rods 62. FIG. 2 also shows in somewhat greater detail the specific location of each of the radar units 40 on the inner wall 34, and the location of each of the associated reflectors 42. As will be described later, the ice detecting units 60 within each zone A–H form a separate ice detecting system within that particular zone such that one or more of the zones may be deiced independently of the other zones should ice or snow accumulate within that zone. By having eight different zones A–H which operate independently of each other, heated air can be directed to only the specific zone or zones which require deicing. This selective deicing of independent, separate zones provides a savings of energy which would otherwise be expended if the entire roof assembly 20 was deiced whenever ice or snow accumulated on only a portion of the roof assembly 20.

Figure 3:
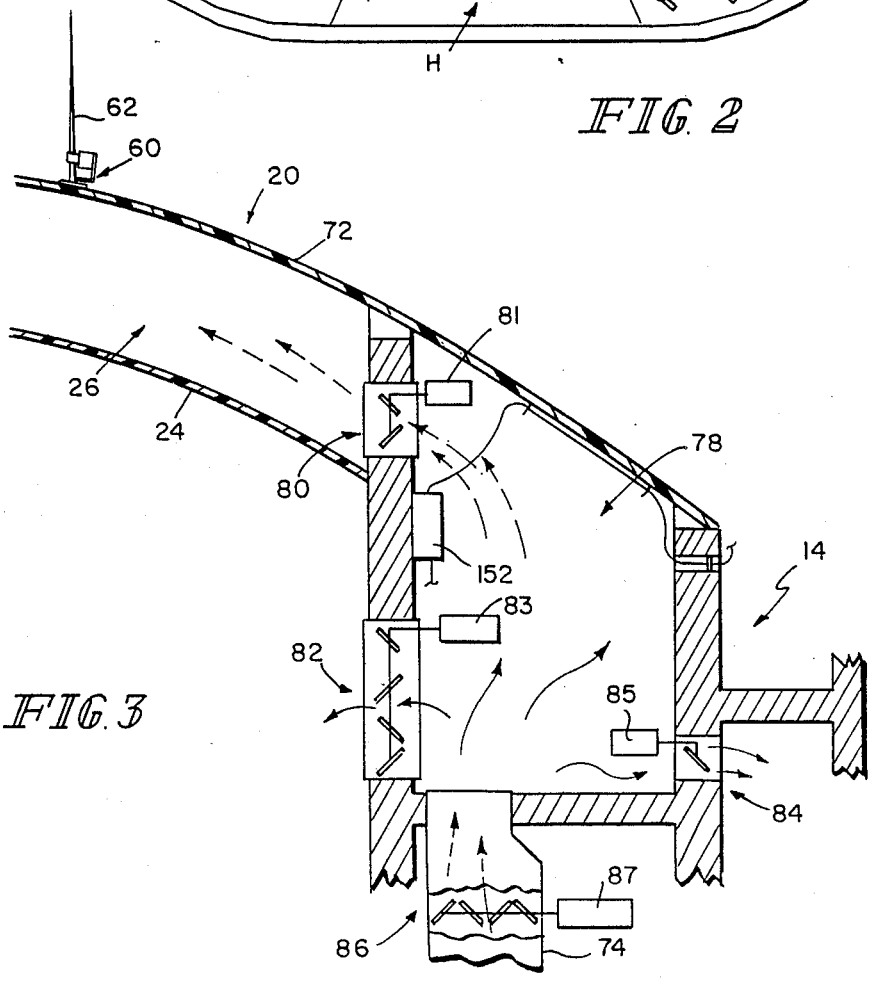
FIG. 3 is a transverse section view through the ring beam plenum area and a portion of the roof structure.
Figure 3:
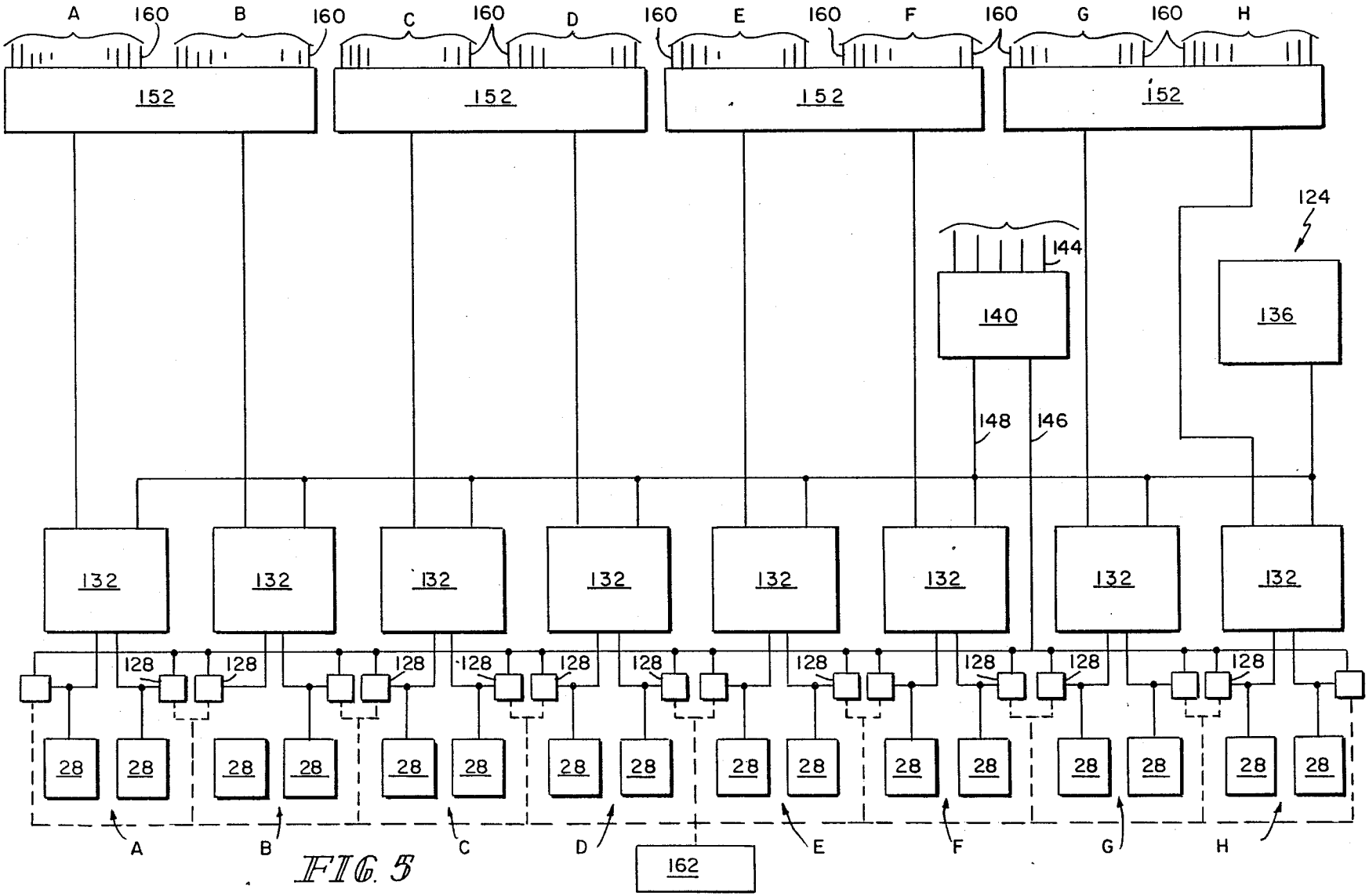

FIG. 3 illustrates in greater detail the ring beam portion 14 and the communication of the heated air from the duct 74 into the roof cavity 26 when deicing of the flexible roof assembly 20 is necessary. The ring beam portion 14 includes a ring plenum area 78 which is in fluid communication with the roof cavity 26. The ring plenum area 78 receives air through the duct 74 from one of the air handling units 28 (not shown in FIG. 3). A roof damper 80 is provided between the ring plenum 78 and the roof cavity 26 to control the flow of air into the roof cavity 26. The roof damper 80 is activated by a damper control 81. Additionally, an upper deck damper 82 is provided which controls the flow of air from the ring plenum 78 into the dome structure 10 itself. The upper deck damper 82 is activated by a damper control 83. A ring pipe damper 84 is provided which selectively directs air from the ring plenum 78 into a pipe containing area (not shown) which houses drain pipes for directing water runoff from the roof 20. The ring pipe damper 84 is activated by a damper control 85. An inlet damper 86 is Positioned in the duct 74 to control the flow of heated air from an associated air handling 28 into the ring plenum 78. A damper control 87 is provided to activate selectively the inlet damper 86.

Whenever the ice detecting system in any one of the zones A–H detects an accumulation of ice or snow as indicated by an accumulation detected by two or three of the ice detecting units 60, the control system (which will be described later) directs the flow of heated air from one of the associated air handling units 28 upwardly through the corresponding duct 74 into the ring plenum 78 adjacent the desired zone A–H. In order to provide the heated air from the correct air handling unit 28, the inlet damper 86 is directed to open by the damper control 87. Additionally, the upper deck damper 82 is closed by the damper control 83. To direct the heated air into the roof cavity 26, the roof damper 80 is opened by the damper control 81. This action permits all of the heated air routed to the ring plenum 78 through the duct 74 to be directed into the roof cavity 26. This heated air directed into the roof cavity 26 acts to melt any accumulation of ice or snow on the outer roof layer 22 of the roof assembly 20, and to prevent any further accumulation of the ice or snow. Additionally, the ring pipe damper 84 is opened by the damper control 85 to route heated air to the area surrounding the drain pipes to prevent any freezing of the drain pipes which are conducting the melting snow and ice from the outer roof layer 22.

As described above, each zone A–H may be deiced separate from any other zone. Thus, if ice and snow is only detected in zone A, then zone A may be deiced individually by routing heated air into zone A independently from the other zones. A programmable logic controller 152 is provided which receives the signals from the individual ice detecting unit 60 to direct the hot air to the appropriate zone or zones when necessary. The cooperation of the programmable logic controller 152 with the control system will be described later in the discussion related to FIG. 5.

Figure 4:
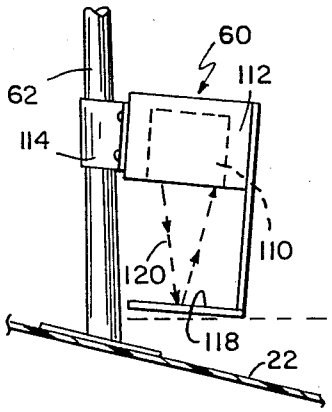
FIG. 4 is a transverse section view taken two lines 4—4 of FIG. 1.

FIG. 4 illustrates in greater detail the structure and positioning of one ice detecting unit 60, and its attachment to one of the lighting rods 62. Each ice detecting unit 60 includes an infrared photoelectric switch 110 which is housed in a weatherproof housing 112. The ice detecting unit 60 is attached to the respective lighting rod 62 by a mounting bracket 114. A collector plate 118 is provided which is spaced apart from the photoelectric switch 110 a distance of between three to six inches. The beam from the photoelectric switch 110 is adjusted such that the ice detecting unit 60 is able to detect an accumulation of ice or snow on the collector plate 118 such that a accumulation of 0.1 inches will activate the ice detecting unit 60.

The collector plate 118 is positioned at an angle to the horizontal so that rain water will run off the collector plate 118 and not accumulate. In the absence of such an angled mounting, it would be possible for rain water to accumulate on the collector plate 118 and possibly activate the ice detecting unit 60 prematurely. It will be understood that deicing of the roof 20 is not necessary when the only accumulation is due to rain water. Ideally, the collector plate 118 is mounted at an angle of least 5° above the horizontal in order to adequately permit rain water runoff but to permit an accumulation of ice or snow. Illustratively, the infrared photoelectric switch 110 is a model no. E3S-LS20XE4 available from Omron Tateisi Electronics Company, One East Commerce Drive, Schaumburg, Ill. 60173. Additionally, the waterproof housing 112 is a number A-645JFG fiberglass enclosure available from Hoffman Engineering Company, 9th and Tyler Street, Anoka, Minn. 55303. The weatherproof housing 112 is heated to prevent the possibility of any ice or snow accumulation on the unit 60 from inhibiting accurate measurement of any accumulation of ice or snow on the collector plate 118. Illustratively, the heating unit is a Ser. No. 030030Cl-PSAS silicone rubber heater available from Watlow Electric Manufacturing Company, 12001 Lackland Road, St. Louis, Mo. 63146.

FIG. 5 shows the control system 124 which controls both the air input into the dome structure 10 as dictated by the actual height measurement from the radar units 40 and the control of the ice and snow melting air from the appropriate air handling units 28. Specifically, FIG. 5 shows how the air handling units 28 are arranged in pairs, with one pair of air handling units 28 dedicated to one of the roof zones A–H. Each individual air handling unit 28 is controlled by a field processing unit 128. Each field processing unit 128 receives an input from a digital system controller 132 which reacts to both the radar determined height of the flexible roof assembly 20 and to the ice detecting system for each individual roof zone, A–H. Illustratively, each digital system controller 132 is a separate computer unit which is designed for heating, ventilating, and air conditioning applications. In the preferred embodiment, each digital system controller 132 is a model DSC-8500 digital system controller available from Johnson Controls, Inc., 507 E. Michigan Street, P.O. Box 423, Milwaukee, Wis. 53201.

The entire array of digital system controllers 132 is controlled by a main digital system controller 136. The main digital system controller 136 monitors the operation of all of the individual digital system controllers 132, and acts to monitor the operation of the entire system and to indicate any discrepancies within the system. The main digital system controller 136 also acts to compare the conventional pressure differential monitoring system with the actual height control system such that, if one system should fail, the main digital system controller 136 will automatically switch control to the properly functioning system. In the preferred embodiment, the main digital system controller 136 is a model DSC-8540 which is also available from Johnson Controls, Inc.

A radar digital system controller 140 is provided to monitor and direct the operation of the individual radar units 40. Specifically, the radar digital system controller 140 functions to activate each of the radar units 40 in sequence such that only one radar unit 40 is operating during any specified period of time. As discussed above, by only permitting one radar unit 40 to be operational at any one time, any possible interference between the radar units 40 is eliminated. In the preferred embodiment, the radar digital system controller 140 controls the five radar units 40 such that a new height signal is generated by each radar unit 40 every four seconds. Thus, the entire cycle of operation of the five radar units 40 is accomplished every four seconds. Each height signal produced by each individual radar unit 40 is averaged by the radar digital system controller 140 by using a moving average technique. This moving average is calculated by accumulating, for example, sixteen radar height inputs from the five radar units 40, and calculating an average height. As a new signal is added to the sixteen original measurements, the oldest signal is dropped and the average is again calculated. Thus, the radar digital system controller 140 acts to provide a damped average radar height of the roof assembly 20. An average height measurement is advantageous because the flexible roof assembly 20 is susceptible to somewhat wave-like motions during windy conditions. Thus, while one portion of the roof assembly 20 may decrease in height somewhat, that decrease in height is compensated for by an increase in height in another portion of the roof assembly 20. Such wave-like motions are normal under certain windy conditions, and no compensation by the air handling units 28 is either necessary or desired. By providing a damped average radar height, such wave-like fluctuations can be averaged out of the system. In the preferred embodiment, like the digital system controller 132, the radar digital system controller 140 is a model DSC-8500 available from Johnson Controls, Inc.

The inputs into the radar digital system controller 140 from the five individual radar units 40 are illustrated by the radar height signal inputs 144. The radar digital system controller 140 has two outputs, the first output 146 is coupled to each of the field processing units 128. The second output 148 is coupled to each of the digital system controllers 132.

Output 148 provides an average height signal to each of the digital system controllers 132, with each digital system controller 132 then acting to control the operation of the respective air handling units 28. Additionally, the output 148 is fed to the main digital system controller 136 which monitors the operation of the entire system.

Each of the field processing units 128 is also coupled to the existing central control panel 162 which provides a pneumatic output signal to each of the field processing units 128 to control the operation of air handling units 28 to maintain the predetermined pressure differential discussed above. It will be understood that the central control panel 162 is a part of the conventional system for controlling the roof height before the installation of the present invention. Each field processing unit 128 includes circuitry which permits the radar height of the roof assembly 20 as supplied by the output 146 to be compared with the pneumatic height indication received from the central control panel 162. Should there be a discrepancy between the radar height inputs to the field processing units as supplied by output 146 of the radar digital system controller 140 and the pneumatic height inputs as received from the central control panel 162, the "or" circuitry within each of the field processing units 128 will cause the field processing units 128 to switch over to pneumatic control. This constant comparison between the radar height and the conventional pneumatic height indications thus provides a constant backup control system should the radar height system fail. Additionally, an alarm (not shown) may be provided by the system to indicate a discrepancy between the radar roof height and the pneumatic roof height.

Four programmable logic controllers 152 are shown, with each logic controller 152 functioning to monitor two of the zones A–H. Specifically, each logic controller 152 functions to monitor the output of the ice detecting units 60 in a pair of zones A–H. For example, one of the logic controllers 152 monitors the ice detecting unit outputs from zones A and B. The ice detecting units 60 produce ice detecting unit signals indicated by the number 160. These ice detecting unit signals 160 are fed to the appropriate programmable logic controller 152 to provide constant monitoring of ice or snow buildup within each of the zones A–H. The Programmable logic controller 152 is Programmed such that if any three ice detecting units 60 within any individual zone A–H indicate an accumulation of ice or snow amounting to a predetermined accumulation, for example 0.1 inches of accumulation, then the programmable logic controller 152 signals the corresponding digital system controller 132 to activate the air handling units 28 dedicated to that zone to direct heated air to the appropriate roof zone via the root cavity 26 as described above in the discussion related to FIG. 3. For example, should three ice detecting units 60 detect a predetermined accumulation of ice within zone A, these three ice detecting units 60 will send ice detecting unit signals 160 into the programmable logic controller 152 which is monitoring zone A. The programmable logic controller 152 will then signal the appropriate digital system controller 132 which is dedicated to zone A. The digital system controller 132 will then send a signal to the pair of air handling units 28 dedicated to zone A such that the air handling units 28 route hot air to the roof cavity 26 within zone A as described above in the discussion related to FIG. 3. After the deicing process has been started in zone A, so long as any one ice detecting unit 60 detects an accumulation of ice or snow above the predetermined level, the programmable logic controller 152 will be programmed to continue the deicing of that zone. Thus, three ice detection unit 60 are required to initiate the deicing process, however the deicing process will continue so long as any one ice detecting unit 60 continues to detect a predetermined accumulation of ice or snow.

Thus, the present invention provides an entirely separate control system for accurately controlling the height and position of the flexible roof assembly 20. This system is independent of the conventional pneumatic monitoring and controlling system, however both systems are compared continuously such that, should either system fail, the operating system will act to maintain the flexible roof assembly 20 in the proper position. The system of the present invention controls the position of the flexible roof assembly 20 by monitoring the actual height of the roof using radar height measurements. This radar height measurement method of controlling the position of the roof assembly 20 is much more accurate than the conventional pneumatic monitoring system. The digital system controllers provided in the system permit constant monitoring of the radar height as well as constant comparison of the radar height and the conventional height indications. The digital system controllers produce an alarm signal and automatic change over functions should either the radar height system or the conventional pneumatic system fail. Thus, the system of the present invention provides not only accurate control of the flexible roof assembly, but also system redundancy.

Although the invention has been described in detail with reference to a preferred embodiment and specific examples, variations and modifications exist within the scope and spirit of the invention as described and defined in the following claims.

What is claimed is:

1. A system for controlling a flexible roof assembly of the type used to cover large structures, the system comprising, means for elevating the level of the roof assembly, means for accurately determining an actual variable height of at least one section of the roof assembly with respect to a fixed reference point, means for generating a signal corresponding to the actual height of the at least one section of the roof assembly in response to said means for determining height, and means for regulating the elevating means utilizing the signal generated by the generating means to accurately control the position of the roof assembly.

2. The system of claim 1, further comprising detecting means for detecting at least one of ice and snow accumulation on an outer surface of the roof assembly and means for reducing such an accumulation controlled by said detecting means.

3. The system of claim 1, wherein the determining means comprises an echo ranging apparatus for determining the actual height of the roof assembly.

4. The system of claim 3, wherein the echo ranging apparatus comprises at least one echo ranging unit, with the at least one echo ranging unit including a reflector unit attached to an inner surface of the at least one section of the roof assembly and an echo transmitter and an associated echo receiver, with the echo transmitter oriented to transmit an echo signal toward the reflector, with the echo signal reflected off of the reflector to create a reflected echo signal, and the associated echo receiver oriented to receive the reflected echo signal, with the transmitted and reflected echo signals evaluated in the generating means to generate the signal corresponding to the actual height of the at least one section of the roof assembly.

5. The system of claim 3, wherein the echo ranging apparatus further comprises a plurality of separate echo ranging units, with each ranging unit having an associated reflector, a transmitter, and a receiver unit, with each associated reflector attached to a separate designated section of the roof assembly such that the actual height of each separate designated section of the roof assembly is determined.

6. The system of claim 1, wherein the generating means includes means for calculating an average height of all of the separate designated sections of the roof assembly, with the average height utilized to generate an average height signal

7. The system of claim 5, further comprising means for alternately activating each transmitter during separate distinct time periods such that only one transmitter is transmitting an echo signal during any one time period.

8. The system of claim 2, wherein the detecting means comprises at least one infrared light sensor unit that is mounted above the level of an outer surface of the roof assembly and that is oriented to measure said at least one of ice and snow accumulation at a location adjacent the infrared light the sensor unit.

9. The system of claim 8, wherein the detecting means further comprises a collecting device mounted adjacent the sensor unit, with the collecting device oriented to collect ice and snow accumulation, and wherein the sensor unit is oriented to measure the accumulation of at least one of said ice and snow in the collecting device.

10. The system of claim 9, wherein the collecting device comprises a substantially flat plate that is inclined somewhat with respect to a horizontal plane such that undesired rain water will run off of the plate and ice and snow will accumulate on the plate.

11. A system for monitoring and controlling the position of a flexible roof assembly of a building structure, the system comprising, means for forcing air into the building structure to elevate the roof assembly, at least one echo ranging device for determining the actual height of at least one section of an inner portion of the roof assembly to produce an actual height measurement, and means for controlling the forcing means in response to the actual height measurement of the at least one section of roof assembly, such that the position of the roof assembly is accurately controlled.

12. The system of claim 11, wherein the controlling means comprises a digital computer that utilizes the actual height measurement to control the forcing means.

13. The system of claim 12, wherein the forcing means comprises at least one fan unit that acts to introduce air into the building structure.

14. The system of claim 13, wherein the at least one fan unit is a variable air volume fan unit.

15. The system of claim 12, wherein the at least one echo ranging device comprises a reflector unit attached to a designated section of the inner portion of the roof assembly and a radar transmitter unit that transmits a radar signal toward the reflector unit and a radar receiver unit that receives the radar signal reflected from the reflector unit such that the actual height of the designated section of the roof assembly is determined.

16. The system of claim 15, wherein there are a plurality of echo ranging devices including a plurality of reflector units attached to separate distinct sections of the inner portion of the roof assembly, and wherein the digital computer computes an average measurement signal corresponding to the average of the actual height measurements from the plurality of echo ranging units.

17. A system for monitoring and controlling the height of a flexible roof assembly for a building enclosing a space, the system comprising, a reflector unit attached to an inner portion of the roof assembly, a radar unit for determining the actual height of the roof assembly by transmitting a radar signal toward the reflector unit and receiving the radar signal reflected from the reflector unit, means for introducing air into the building space to regulate the height of the roof assembly, and means responsive to the actual height of the roof assembly for controlling the introducing means to control the height of the roof assembly, whereby the height of the roof assembly can be maintained at a desired level.

18. The system of claim 17, wherein the controlling means comprises a digital computer device that utilizes as an input the actual height of the roof assembly and that produces as an output a control signal for controlling the introducing means.

19. The system of claim 16, wherein these are a plurality of separate radar units and wherein the system further comprises means for alternately activating each of the plurality of radar units during a separate distinct time period such that only one radar unit is activated at any one time.

20. The system of claims 17, further comprising means for detecting at least one of ice and snow build-up on an outer portion of the roof assembly.

21. The system of claim 20, wherein the detecting means comprises at least one infrared photoelectric sensor that is mounted above the level of the outer portion of the roof assembly and that is oriented to detect a build-up of at least one of ice and snow on the surface of the outer portion of the roof assembly.

22. The system of claim 21, wherein the entire outer portion of the roof assembly is divided into a designated member of separate zones, and wherein at least one sensor is located in each separate zone.

23. An apparatus for detecting the presence of at least one of ice and snow in an area of an outer surface of a roof assembly, the apparatus comprising, a collecting device that is mounted in the area of the outer surface of the roof assembly and that is oriented to collect ice and snow that is accumulating in the area, and a sensor unit that is directed toward the collecting device to detect an accumulation of at least one ice or snow that reaches a specified depth.

24. The apparatus of claim 23, wherein the sensor unit comprises an infrared photoelectric light unit.

25. A system for monitoring and controlling the height of a flexible roof assembly of a building structure comprising:

at least one echo ranging means for sensing changes in height of at least one section of an inner portion of the roof assembly;

said echo ranging means producing a control signal; and roof height controlling means, responsive to said signal of said echo ranging device, to adjust the height of the roof assembly.

26. The system of claim 25 wherein there is a control means which compares the echo ranging device signal to a desired height signal and actuates the roof height controlling means to maintain said echo ranging device control signal equal to said desired height signal.

27. The system of claim 25, wherein the roof height means forces air into the building structure to adjust the height of the roof.

28. The system of claim 26, wherein the roof height controlling means forces air into the building structure to adjust the height of the roof.

29. The system of claim 25 wherein the echo ranging means includes a plurality of echo transmitting units each with a echo reflector and receiver unit spaced from each other;

wherein each receiver unit produces a control signal unit;

and wherein the roof height controlling means is responsive to each control signal of each receiver unit.

30. The system of claim 29 wherein the plurality of echo transmitting units are activated seriatim so only one unit is operating at a given time.

* * * * *

UNITED STATES PATENT AND TRADEMARK OFFICE

CERTIFICATE OF CORRECTION

PATENT NO. : 4,936,060

DATED : June 26, 1990

INVENTOR(S) : Richard Gelinas et al.

It is certified that error appears in the above-identified patent and that said Letters Patent is hereby corrected as shown below:

ON TITLE PAGE: item 73, after "J.W. Welsh & Associates, Inc.", please delete "Marion County; The Capital Improvement Board of Managers" and insert therefor --Indianapolis; The Capital Improvement Board of Managers of Marion County, Indiana--.

In column 8, line 14, please delete "Positioned" and insert therefor --positioned--.

In column 11, line 16, please delete "Programmable" and insert therefor --programmable--.

In column 14, line 29, please delete "area" and insert therefor --areas--.

Signed and Sealed this

Third Day of December, 1991

*Attest:*

HARRY F. MANBECK, JR.

*Attesting Officer*

*Commissioner of Patents and Trademarks*